US011423847B2

(12) United States Patent
Lim et al.

(10) Patent No.: US 11,423,847 B2
(45) Date of Patent: Aug. 23, 2022

(54) DISPLAY DEVICE AND METHOD OF OPERATING A DISPLAY DEVICE

(71) Applicant: Samsung Display Co., Ltd., Yongin-si (KR)

(72) Inventors: Hyunho Lim, Jecheon-si (KR); Bongho Bae, Suwon-si (KR); Ok-Kwon Shin, Seoul (KR); Hyun Ha Yang, Seoul (KR); Chongguk Lee, Seoul (KR); Myeong Bin Lim, Hwaseong-si (KR); Sehui Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/823,184

(22) Filed: Mar. 18, 2020

(65) Prior Publication Data

US 2020/0394966 A1 Dec. 17, 2020

(30) Foreign Application Priority Data

Jun. 17, 2019 (KR) ..... 10-2019-0071658

(51) Int. Cl.
*G09G 3/3291* (2016.01)
*G09G 3/36* (2006.01)

(52) U.S. Cl.
CPC ..... *G09G 3/3291* (2013.01); *G09G 3/3688* (2013.01); *G09G 2320/0223* (2013.01); *G09G 2330/021* (2013.01)

(58) Field of Classification Search
CPC ..... G09G 3/3291; G09G 3/3688; G09G 2330/021; G09G 2320/0223
See application file for complete search history.

(56) References Cited

U.S. PATENT DOCUMENTS

2011/0169801 A1* 7/2011 Hsieh ..... G09G 5/003 345/211
2012/0212474 A1* 8/2012 Hwang ..... G09G 3/3648 345/212
2015/0103065 A1* 4/2015 Kim ..... G09G 3/3688 345/212
2016/0189655 A1* 6/2016 Choi ..... G09G 3/3674 345/215
2016/0372044 A1* 12/2016 Kwon ..... G09G 3/3291
2018/0211602 A1 7/2018 Cho et al.

FOREIGN PATENT DOCUMENTS

KR 10-2016-0148831 A 12/2016
KR 10-2018-0062332 A 6/2018

* cited by examiner

*Primary Examiner* — Jeff Piziali
(74) *Attorney, Agent, or Firm* — Lewis Roca Rothgerber Christie LLP

(57) ABSTRACT

A display device includes: a display panel including a plurality of pixels; a power management circuit configured to generate an analog power supply voltage; and a data driver configured to provide a pre-emphasis voltage and a data voltage to the plurality of pixels based on the analog power supply voltage, wherein the display device is configured to adjust a voltage level of the pre-emphasis voltage according to a distance from the data driver to each of the plurality of pixels to which the pre-emphasis voltage is applied, and wherein the display device is configured to adjust a voltage level of the analog power supply voltage according to the adjusted voltage level of the pre-emphasis voltage.

17 Claims, 7 Drawing Sheets

DISPLAY DEVICE AND METHOD OF OPERATING A DISPLAY DEVICE

CROSS-REFERENCE TO RELATED APPLICATION(S)

The present application claims priority to and the benefit of Korean Patent Application No. 10-2019-0071658, filed on Jun. 17, 2019 in the Korean Intellectual Property Office (KIPO), the entire content of which is incorporated herein in its entirety by reference.

BACKGROUND

1. Field

Aspects of some example embodiments of the present inventive concept relate to a display device.

2. Description of the Related Art

A display device provides a data voltage to a pixel to display an image corresponding to the data voltage. However, as a distance from a data driver to the pixel increases, a transition time during which the data voltage reaches a desired voltage level may be increased by a resistor-capacitor (RC) delay. Accordingly, the data voltage having the desired voltage level may not be stored in the pixel, and thus an image quality of the display device may be deteriorated. Further, as a resolution of the display device increases, one horizontal time (1H) decreases, and thus the deterioration of its image quality may escalate.

To store the data voltage having the desired voltage level in the pixel, a pre-emphasis driving method that applies a pre-emphasis voltage higher than the data voltage may be utilized. However, in a pre-emphasis driving method, because the pre-emphasis voltage higher than the data voltage may be used, power consumption of the display device may be increased.

The above information disclosed in this Background section is only for enhancement of understanding of the background and therefore the information discussed in this Background section does not necessarily constitute prior art.

SUMMARY

Aspects of some example embodiments of the present inventive concept relate to a display device, and for example, to a display device that adjusts an analog power supply voltage, and a method of operating the display device.

Some example embodiments include a display device that may be capable of reducing power consumption.

Some example embodiments include a method of operating a display device that may be capable of reducing power consumption.

According to some example embodiments, there is provided a display device including a display panel including a plurality of pixels, a power management circuit configured to generate an analog power supply voltage, and a data driver configured to provide a pre-emphasis voltage and a data voltage to the plurality of pixels based on the analog power supply voltage. A voltage level of the pre-emphasis voltage is adjusted according to a distance from the data driver to each of the plurality of pixels to which the pre-emphasis voltage is applied. A voltage level of the analog power supply voltage is adjusted according to the adjusted voltage level of the pre-emphasis voltage.

According to some example embodiments, the voltage level of the analog power supply voltage may be adjusted such that a difference between the analog power supply voltage and the pre-emphasis voltage is maintained as a predetermined margin voltage.

According to some example embodiments, the voltage level of the pre-emphasis voltage may be increased as the distance from the data driver to each of the plurality of pixels to which the pre-emphasis voltage is applied increases, and the voltage level of the analog power supply voltage may be increased as the voltage level of the pre-emphasis voltage increases.

According to some example embodiments, the data driver may provide the pre-emphasis voltage having a first voltage level to a first one of the plurality of pixels spaced apart by a first distance from the data driver, and may provide the pre-emphasis voltage having a second voltage level higher than the first voltage level to a second one of the plurality of pixels spaced apart by a second distance greater than the first distance from the data driver. The power management circuit may provide the analog power supply voltage having a third voltage level to the data driver when the data driver provides the pre-emphasis voltage having the first voltage level to the first one of the plurality of pixels, and may provide the analog power supply voltage having a fourth voltage level higher than the third voltage level to the data driver when the data driver provides the pre-emphasis voltage having the second voltage level to the second one of the plurality of pixels.

According to some example embodiments, the third voltage level of the analog power supply voltage may be higher by a predetermined margin voltage than the first voltage level of the pre-emphasis voltage, and the fourth voltage level of the analog power supply voltage may be higher by the predetermined margin voltage than the second voltage level of the pre-emphasis voltage.

According to some example embodiments, the display device may further include a controller configured to control the power management circuit and the data driver. The power management circuit may adjust the voltage level of the analog power supply voltage in response to an analog power supply voltage control signal received from the controller.

According to some example embodiments, the power management circuit may include a voltage converting block configured to convert an input voltage into the analog power supply voltage, and a switch control block configured to control the voltage converting block to adjust the voltage level of the analog power supply voltage in response to the analog power supply voltage control signal.

According to some example embodiments, the analog power supply voltage control signal may be transferred from the controller to the power management circuit through a single wire.

According to some example embodiments, a display device includes a display panel including a plurality of pixels, a power management circuit configured to generate an analog power supply voltage, a pre-emphasis voltage determining block configured to determine a voltage level of a pre-emphasis voltage, and a data driver configured to provide the pre-emphasis voltage having the determined voltage level and a data voltage to the plurality of pixels based on the analog power supply voltage. A voltage level of the analog power supply voltage is adjusted according to the determined voltage level of the pre-emphasis voltage.

According to some example embodiments, the voltage level of the analog power supply voltage may be adjusted such that a difference between the analog power supply voltage and the pre-emphasis voltage is maintained as a predetermined margin voltage.

According to some example embodiments, the pre-emphasis voltage determining block may determine the voltage level of the pre-emphasis voltage according to a distance from the data driver to each of the plurality of pixels to which the pre-emphasis voltage is applied.

According to some example embodiments, the pre-emphasis voltage determining block may determine the voltage level of the pre-emphasis voltage based on a distance from the data driver to each of the plurality of pixels to which the pre-emphasis voltage is applied, and a difference between previous pixel data and current pixel data.

According to some example embodiments, the display device may further include a controller configured to control the power management circuit and the data driver. The power management circuit may adjust the voltage level of the analog power supply voltage in response to an analog power supply voltage control signal received from the controller.

According to some example embodiments, the power management circuit may include a voltage converting block configured to convert an input voltage into the analog power supply voltage, and a switch control block configured to control the voltage converting block to adjust the voltage level of the analog power supply voltage in response to the analog power supply voltage control signal.

According to some example embodiments, the pre-emphasis voltage determining block may be included in the controller.

According to some example embodiments, in a method of operating a display device, a voltage level of a pre-emphasis voltage is determined, a voltage level of the analog power supply voltage is adjusted according to the determined voltage level of the pre-emphasis voltage, and the pre-emphasis voltage having the determined voltage level and a data voltage are provided to the plurality of pixels based on the analog power supply voltage having the adjusted voltage level.

According to some example embodiments, the voltage level of the analog power supply voltage may be adjusted such that a difference between the analog power supply voltage and the pre-emphasis voltage is maintained as a predetermined margin voltage.

According to some example embodiments, a panel load may be determined according to a distance from the data driver to each of the plurality of pixels to which the pre-emphasis voltage is applied, and the voltage level of the pre-emphasis voltage may be determined based on the panel load.

According to some example embodiments, a panel load may be determined according to a distance from the data driver to each of the plurality of pixels to which the pre-emphasis voltage is applied, a difference between previous pixel data and current pixel data may be calculated, and the voltage level of the pre-emphasis voltage may be determined based on the panel load and the calculated difference.

According to some example embodiments, the voltage level of the analog power supply voltage may be adjusted by a power management circuit in response to an analog power supply voltage control signal received from a controller.

As described above, a display device and a method of operating the display device according to some example embodiments may adjust a voltage level of a pre-emphasis voltage according to a distance from a data driver to a pixel to which the pre-emphasis voltage is applied, and may adjust a voltage level of an analog power supply voltage according to the adjusted voltage level of the pre-emphasis voltage. Accordingly, compared with a related art display device using a fixed analog power supply voltage, a power consumption of the display device according to example embodiments may be relatively reduced.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
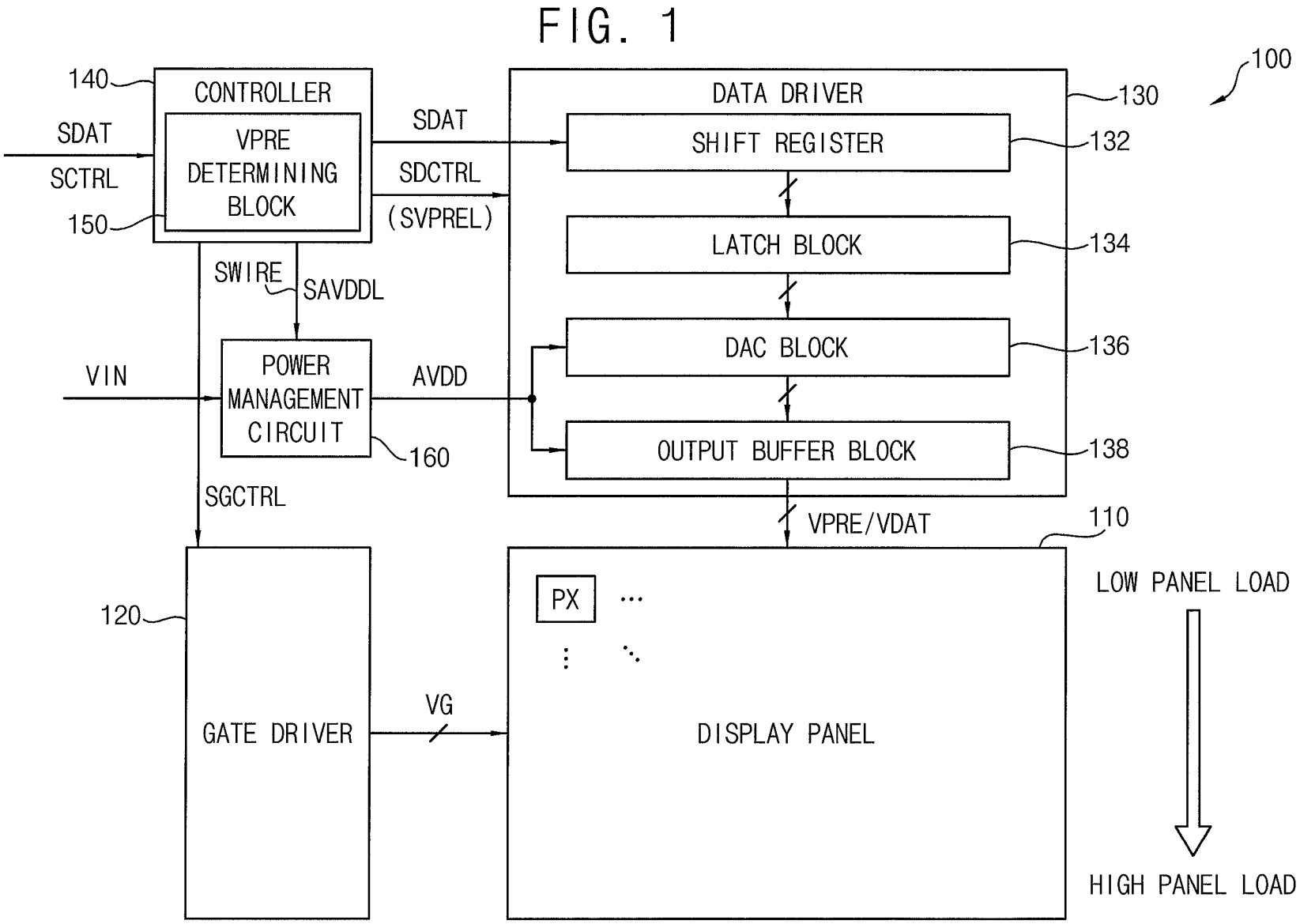
FIG. 1 is a block diagram illustrating a display device according to some example embodiments.

The example embodiments are described more fully hereinafter with reference to the accompanying drawings. Like or similar reference numerals refer to like or similar elements throughout.

Figure 2:
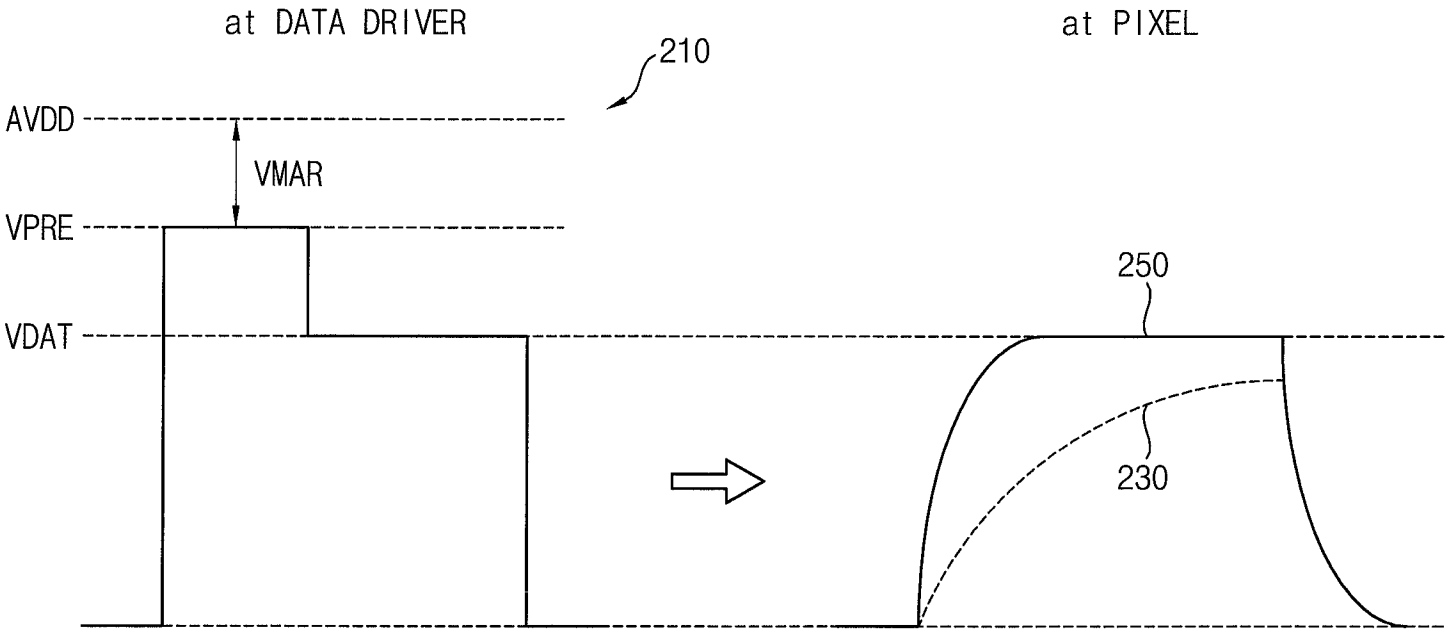
FIG. 2 is a diagram illustrating examples of a pre-emphasis voltage and a data voltage at a data driver and examples of the pre-emphasis voltage and the data voltage at a pixel according to some example embodiments.
Figure 3:
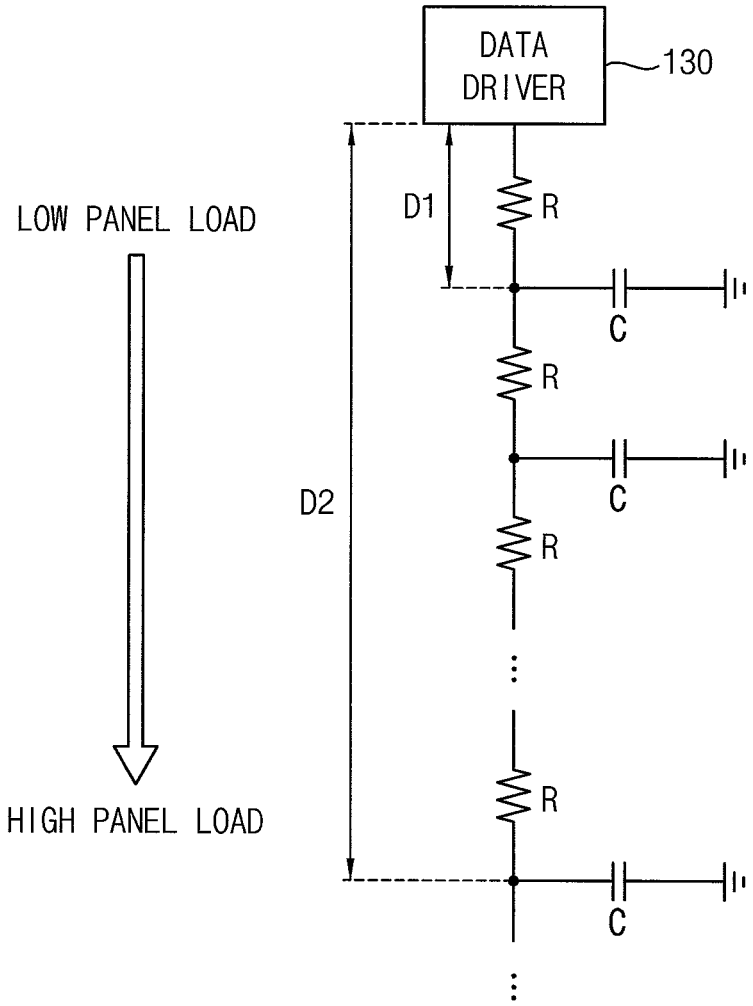
FIG. 3 is a diagram illustrating an example of an equivalent model of one data line and a plurality of pixels coupled to the data line according to some example embodiments.
Figure 4:
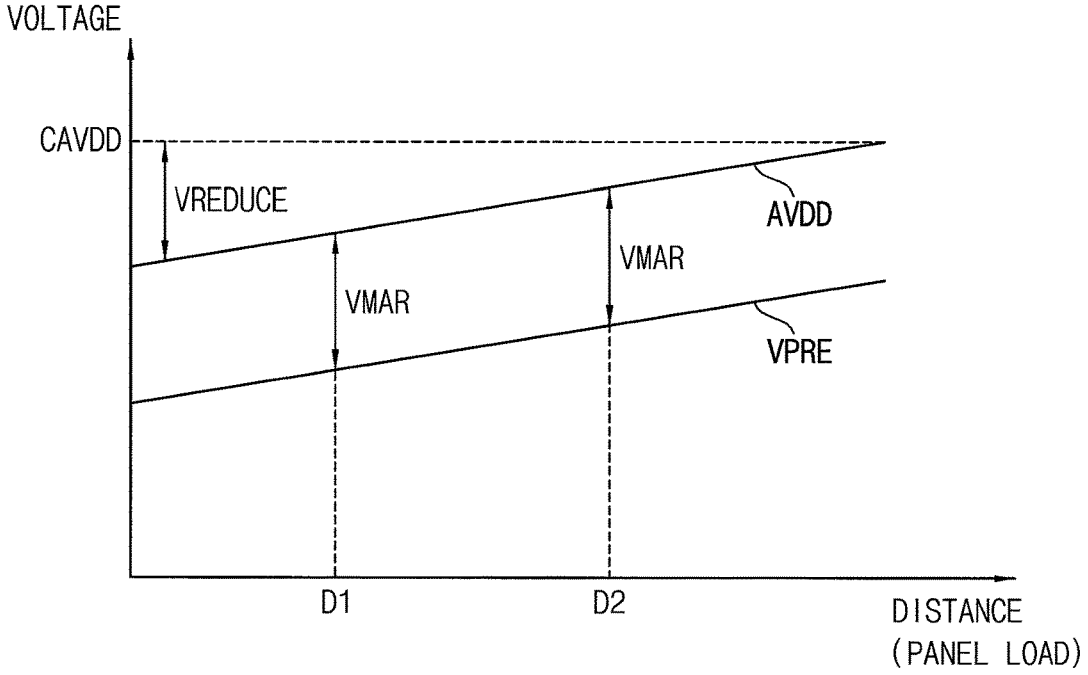
FIG. 4 is a graph illustrating a pre-emphasis voltage and an analog power supply voltage according to a distance from a data driver to a pixel according to some example embodiments.
Figure 5:
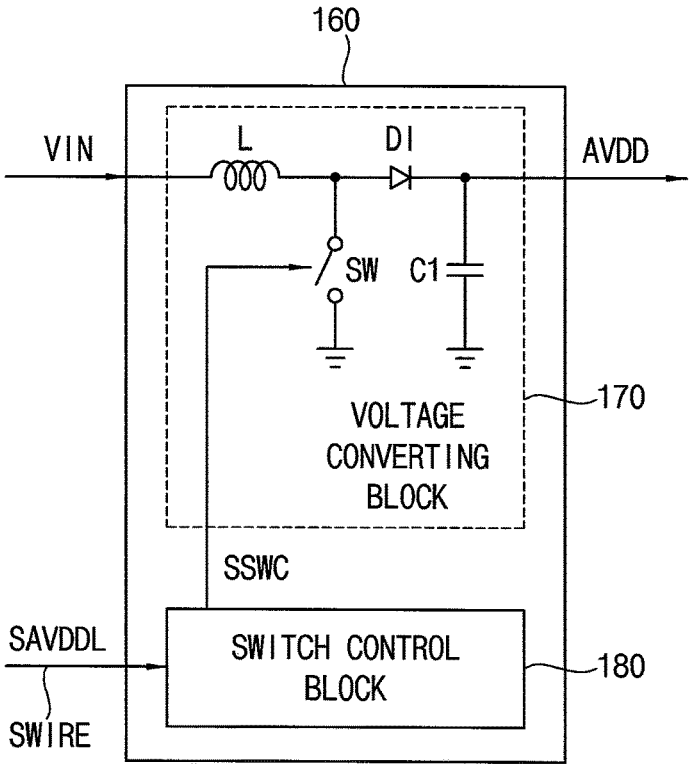
FIG. 5 is a diagram illustrating an example of a power management circuit included in a display device of FIG. 1 according to some example embodiments.

FIG. 1 is a block diagram illustrating a display device according to some example embodiments, FIG. 2 is a diagram illustrating examples of a pre-emphasis voltage and a data voltage at a data driver and examples of the pre-emphasis voltage and the data voltage at a pixel, FIG. 3 is a diagram illustrating an example of an equivalent model of one data line and a plurality of pixels coupled to the data line, FIG. 4 is a graph illustrating a pre-emphasis voltage and an analog power supply voltage according to a distance from a data driver to a pixel, and FIG. 5 is a diagram illustrating an example of a power management circuit included in a display device of FIG. 1.

Referring to FIG. 1, a display device 100 may include a display panel 110, which includes a plurality of pixels PX, a gate driver 120, which provides a gate voltage VG to the plurality of pixels PX, a data driver 130, which provides a pre-emphasis voltage VPRE and a data voltage VDAT to the plurality of pixels PX, a power management circuit 160, which generates an analog power supply voltage AVDD, and a controller 140 which controls the gate driver 120, the data driver 130 and the power management circuit 160.

The display panel 110 may include a plurality of gate lines, a plurality of data lines, and the plurality of pixels PX coupled to the plurality of gate lines and the plurality of data lines. In some example embodiments, each pixel PX may include at least two transistors, at least one capacitor, and an organic light emitting diode (OLED), and the display panel 110 may be an OLED display panel. In other example embodiments, each pixel PX may include a switching transistor, and a liquid crystal capacitor coupled to the switching transistor, and the display panel 110 may be a liquid crystal display (LCD) panel. However, the display panel 110 may not be limited to the OLED panel and the LCD panel, and may include any suitable display panel according to the design of the display device 100.

The gate driver 120 may generate the gate voltage VG based on a gate control signal SGCTRL provided from the controller 140, and may sequentially apply the gate voltage VG to the plurality of pixels PX on a row-by-row basis. In some example embodiments, the gate control signal SGCTRL may include, but not be limited to, a start signal, a gate clock signal, etc. According to example embodiments, the gate driver 120 may be mounted directly on the display panel 110, may be coupled to the display panel 110 in a form of a tape carrier package (TCP), and may be integrated in a peripheral portion of the display panel 110.

The data driver 130 may receive an image data signal SDAT and a data control signal SDCTRL from the controller 140, may receive the analog power supply voltage AVDD from the power management circuit 160, and may provide the pre-emphasis voltage VPRE and the data voltage VDAT to the plurality of pixels PX based on the image data signal SDAT, the data control signal SDCTRL and the analog power supply voltage AVDD. The data control signal SDCTRL may include a pre-emphasis voltage control signal SVPREL representing a voltage level of the pre-emphasis voltage VPRE. In some example embodiments, the data control signal SDCTRL may further include, but is limited to, a horizontal start signal, a load signal, etc. According to some example embodiments, the data driver 130 may be mounted directly on the display panel 110, may be coupled to the display panel 110 in the form the TCP, and may be integrated in the peripheral portion of the display panel 110.

The analog power supply voltage AVDD may be used as a power supply voltage for an analog circuit of the data driver 130. In some example embodiments, the data driver 130 may include a shift register 132 that sequentially receives and stores the image data signal SDAT from the controller 140, a latch block (or latch circuit) 134 that temporarily stores the image data signal SDAT received from the shift register 132, a digital-to-analog converting (DAC) block (or DAC circuit) 136 that generates the pre-emphasis voltage VPRE having the voltage level represented by the pre-emphasis voltage control signal SVPREL and the data voltage VDAT corresponding to the image data signal SDAT output from the latch block 134 based on the analog power supply voltage AVDD, and an output buffer block (or output buffer circuit) 138 that outputs the pre-emphasis voltage VPRE and the data voltage VDAT based on the analog power supply voltage AVDD. The DAC block 136 and the output buffer block 138 may receive, as the power supply voltage, the analog power supply voltage AVDD.

As illustrated by 210 in FIG. 2, the data driver 130 may sequentially provide the pre-emphasis voltage VPRE and the data voltage VDAT to each pixel PX. In a case where the pre-emphasis voltage VPRE is not provided to each pixel PX, the data voltage VDAT at each pixel PX may be delayed according to a panel load of the display panel 110, or according to a distance from the data driver 130 to each pixel PX. For example, as illustrated in FIG. 3, one data line and a plurality of pixels PX coupled to the data line may be represented as an equivalent model including resistors R coupled in series and capacitors C coupled to the resistors R, and the data voltage VDAT may be delayed by a resistor-capacitor (RC) delay of the resistors R and the capacitors C according to the distance from the data driver 130 to each pixel PX.

In the case where the pre-emphasis voltage VPRE is not used, as illustrated by 230 in FIG. 2, the data voltage VDAT at each pixel PX may not reach a desired voltage level within a gate-on time (or a scan-on time) during which the gate voltage VG is applied to the pixel PX. In this case, the data voltage VDAT having the desired voltage level may not be stored in the pixel PX, and thus an image quality of the display device 100 may be deteriorated. Further, as a resolution of the display device 100 increases, one horizontal time (1H), or the gate on time (or the scan on time) may decrease, and thus the deterioration of the display device 100 may escalate. However, as illustrated by 210 in FIG. 2, the data driver 130 of the display device 100 according to some example embodiments may output the pre-emphasis voltage VPRE higher than the data voltage VDAT before outputting the data voltage VDAT. If the pre-emphasis voltage VPRE and the data voltage VDAT are sequentially output from the output buffer block 138 of the data driver 130, as illustrated by 250 in FIG. 2, the data voltage VDAT at each pixel PX may reach the desired voltage level within the gate on time (or the scan on time) even in the pixel PX distant from the data driver 130. Accordingly, the deterioration of the image quality caused by the RC delay may be reduced or prevented. Thus, according to some example embodiments, by applying a pre-emphasis voltage VPRE that is higher than the data voltage VDAT, prior to outputting the data voltage VDAT, the display device 100 may avoid or reduce scenarios in which the desired data voltage VDAT is not stored in the pixel PX within the storage period (e.g., the gate-on time or scan-on time).

The power management circuit 160 may generate the analog power supply voltage AVDD based on an input voltage (e.g., a battery voltage) VIN. For example, the power management circuit 160 may be implemented with a DC-DC converter that converts the input voltage VIN into the analog power supply voltage AVDD. In order that the data driver 130 can output the pre-emphasis voltage VPRE higher than the data voltage VDAT as illustrated in FIG. 2, the power management circuit 160 may generate the analog power supply voltage AVDD to be higher than the pre-emphasis voltage VPRE by a margin voltage (e.g., a set or predetermined margin voltage) VMAR. Thus, because the output buffer block 138 of the data driver 130 receives the analog power supply voltage AVDD that is higher than the pre-emphasis voltage VPRE by an amount of the margin voltage (e.g., the set or predetermined margin voltage) VMAR, a driving capability of the output buffer block 138 may be sufficient to output the high pre-emphasis voltage VPRE. In some example embodiments, the power management circuit 160 may further generate (but embodiments are not limited to) a gamma reference voltage, a high/low gate voltage, etc. Further, in some example embodiments, the power management circuit 160 may be implemented in a form of (but embodiments are not limited to) a power management integrated circuit (PMIC).

The controller (e.g., a timing controller (TCON)) 140 may receive the image data signal SDAT and a control signal CTRL from an external host (e.g., a graphic processing unit (GPU), a graphic card, etc.). For example, the image data signal SDAT may be (but is not limited to) an RGB data including red image data, green image data and blue image data. Further, for example, the control signal SCTRL may include (but is not limited to) a data enable signal, a master clock signal, etc. The controller 140 may control an operation of the gate driver 120 by providing the gate control signal SGCTRL to the gate driver 120, and may control an operation of the data driver 130 by providing the data control signal SDCTRL and the image data signal SDAT to the data driver 130. Further, according to some example embodiments, the controller 140 may provide the pre-emphasis voltage control signal SVPREL to the data driver 130 to adjust the voltage level of the pre-emphasis voltage VPRE, and may provide an analog power supply voltage control signal SAVDDL to the power management circuit 160 to adjust a voltage level of the analog power supply voltage AVDD.

In the display device 100 according to some example embodiments, the panel load of the display panel 110 may be increased as the distance from the data driver 130 increases. In an example of FIG. 3, compared with the panel load for the pixel PX spaced by a first distance D1 from the data driver 130, the panel load for the pixel PX spaced by a second distance D2 greater than the first distance D1 from the data driver 130 may be increased. In the display device 100 according to example embodiments, by considering the panel load changed according to the distance from the data driver 130 to each pixel PX, the voltage level of the pre-emphasis voltage VPRE may be adjusted according to the distance from the data driver 130 to each pixel PX to which the pre-emphasis voltage VPRE is applied. For example, as illustrated in FIG. 4, as the distance from the data driver 130 to the pixel PX to which the pre-emphasis voltage VPRE is applied increases, the voltage level of the pre-emphasis voltage VPRE may be increased.

To adjust the voltage level of the pre-emphasis voltage VPRE, the display device 100 according to example embodiments may further include a pre-emphasis voltage determining block 150 that determines the voltage level of the pre-emphasis voltage VPRE periodically (e.g., on a row-by-row basis). The pre-emphasis voltage determining block 150 may provide the data driver 130 with the pre-emphasis voltage control signal SVPREL representing the determined voltage level of the pre-emphasis voltage VPRE. The data driver 130 may output the pre-emphasis voltage VPRE having the voltage level represented by the pre-emphasis voltage control signal SVPREL. In some example embodiments, the pre-emphasis voltage determining block 150 may be included in the controller 140, but the location of the pre-emphasis voltage determining block (or pre-emphasis voltage determining circuit) 150 may not be limited thereto. For example, in other example embodiments, the pre-emphasis voltage determining block 150 may be implemented within the data driver 130.

In some example embodiments, the pre-emphasis voltage determining block 150 may determine the voltage level of the pre-emphasis voltage VPRE according to the panel load of the display panel 110, or according to the distance from the data driver 130 to the pixel PX to which the pre-emphasis voltage VPRE is applied. For example, the pre-emphasis voltage determining block 150 may determine the voltage level of the pre-emphasis voltage VPRE to a relatively low voltage level when the pre-emphasis voltage VPRE is applied to the pixels PX in a row relatively close to the data driver 130, and may determine the voltage level of the pre-emphasis voltage VPRE to a relatively high voltage level when the pre-emphasis voltage VPRE is applied to the pixels PX in a row relatively far from the data driver 130. In this case, substantially the same pre-emphasis voltage VPRE may be applied to the pixels PX in the same row.

In other example embodiments, the pre-emphasis voltage determining block 150 may determine the voltage level of the pre-emphasis voltage VPRE based on not only the distance from the data driver 130 to the pixel PX to which the pre-emphasis voltage VPRE is applied, but also a difference between previous pixel data and current pixel data. For example, with respect to two pixels PX coupled to the same data line and located in a previous row and a current row, the pre-emphasis voltage determining block 150 may increase the voltage level of the pre-emphasis voltage VPRE as the difference between the image data signal SDAT (i.e., the previous pixel data) for the pixel PX in the previous row and the image data signal SDAT (i.e., the current pixel data) for the pixel PX in the current row increases. In this case, different pre-emphasis voltages VPRE may be applied to the pixels PX in the same row.

In a related art display device, as illustrated by a dotted line in FIG. 4, a constant analog power supply voltage CAVDD having a fixed voltage level may be provided to the data driver 130 even if the voltage level of the pre-emphasis voltage VPRE is changed according to the panel load of the display panel 110. However, in the display device 100 according to example embodiments, as illustrated in FIG. 4, the voltage level of the pre-emphasis voltage VPRE may be adjusted according to the panel load of the display panel 110, or the distance from the data driver 130 to each pixel PX (and/or according to the difference between the previous pixel data and the current pixel data), and the voltage level of the analog power supply voltage AVDD may be adjusted according to the adjusted voltage level of the pre-emphasis voltage VPRE. Accordingly, the analog power supply voltage AVDD in the display device 100 according to example embodiments may be reduced by a reduction voltage VREDUCE compared with the constant analog power supply voltage CAVDD in the related art display device, and thus a power consumption of the display device 100 may be reduced.

In some example embodiments, the voltage level of the pre-emphasis voltage VPRE may be increased as the panel load of the display panel 110 increases, or as the distance from the data driver 130 to the pixel PX to which the pre-emphasis voltage VPRE is applied increases, and the voltage level of the analog power supply voltage AVDD may be increased as the voltage level of the pre-emphasis voltage VPRE increases. In some example embodiments, the voltage level of the analog power supply voltage AVDD may be adjusted such that a difference between the analog power supply voltage AVDD and the pre-emphasis voltage VPRE may be maintained as the margin voltage (e.g., the set or predetermined margin voltage) VMAR. For example, the margin voltage (e.g., the set or predetermined margin voltage) VMAR may be (but is limited to) about 0.5 V.

For example, as illustrated in FIGS. 3 and 4, the data driver 130 may provide the pre-emphasis voltage VPRE having a first voltage level to a first pixel PX spaced apart by a first distance D1 from the data driver 130, and may provide the pre-emphasis voltage VPRE having a second voltage level higher than the first voltage level to a second pixel PX spaced apart by a second distance D2 greater than the first distance D1 from the data driver 130. Further, the power management circuit 160 may provide the analog power supply voltage AVDD having a third voltage level to the data driver 130 when the data driver 130 provides the pre-emphasis voltage VPRE having the first voltage level to the first pixel PX, and may provide the analog power supply voltage AVDD having a fourth voltage level higher than the third voltage level to the data driver 130 when the data driver 130 provides the pre-emphasis voltage VPRE having the second voltage level to the second pixel PX. In this case, the third voltage level of the analog power supply voltage VADD may be higher by the margin voltage (e.g., the set or predetermined margin voltage) VMAR than the first voltage level of the pre-emphasis voltage VPRE, and the fourth voltage level of the analog power supply voltage VADD may be higher by the margin voltage (e.g., the set or predetermined margin voltage) VMAR than the second voltage level of the pre-emphasis voltage VPRE. Thus, because the analog power supply voltage AVDD is higher by the margin voltage (e.g., the set or predetermined margin voltage) VMAR than the pre-emphasis voltage VPRE, the driving capability of the output buffer block 138 that receives the analog power supply voltage AVDD may be maintained even if the voltage level of the analog power supply voltage AVDD is changed.

To adjust the analog power supply voltage AVDD, the controller 140 may provide the analog power supply voltage control signal SAVDDL to the power management circuit 160, and the power management circuit 160 may adjust the voltage level of the analog power supply voltage AVDD in response to the analog power supply voltage control signal SAVDDL received from the controller 140. To adjust the voltage level of the analog power supply voltage AVDD in response to the analog power supply voltage control signal SAVDDL, as illustrated in FIG. 5, the power management circuit 160 may include a voltage converting block 170 that convert the input voltage VIN into the analog power supply voltage AVDD, and a switch control block 180 that controls the voltage converting block 170 in response to the analog power supply voltage control signal SAVDDL.

For example, the voltage converting block 170 may include an inductor L, a switching element SW, a diode DI and a capacitor C1, and may be a boost converter for boosting the input voltage VIN to the analog power supply voltage AVDD. However, the voltage converting block 170 may not be limited to the boost converter. Further, for example, the switch control block 180 may control the voltage converting block 170 to adjust the voltage level of the analog power supply voltage AVDD by adjusting a duty of a switch control signal SSWC for controlling the switching element SW of the voltage converting block 170 in response to the analog power supply voltage control signal SAVDDL. In some example embodiments, the analog power supply voltage control signal SAVDDL may be transferred from the controller 140 to the power management circuit 160 through a single wire SWIRE. However, the wiring of the analog power supply voltage control signal SAVDDL may not be limited to the single wire SWIRE.

As described above, the display device 100 according to example embodiments may adjust the voltage level of the pre-emphasis voltage VPRE according to the panel load of the display panel 110, or according to the distance from the data driver 130 to each pixel PX to which the pre-emphasis voltage VPRE is applied, and may adjust the voltage level of the analog power supply voltage AVDD according to the adjusted voltage level of the pre-emphasis voltage VPRE. Accordingly, compared with a display device using the constant analog power supply voltage CAVDD, the power consumption of the display device 100 according to example embodiments may be reduced.

Figure 6:
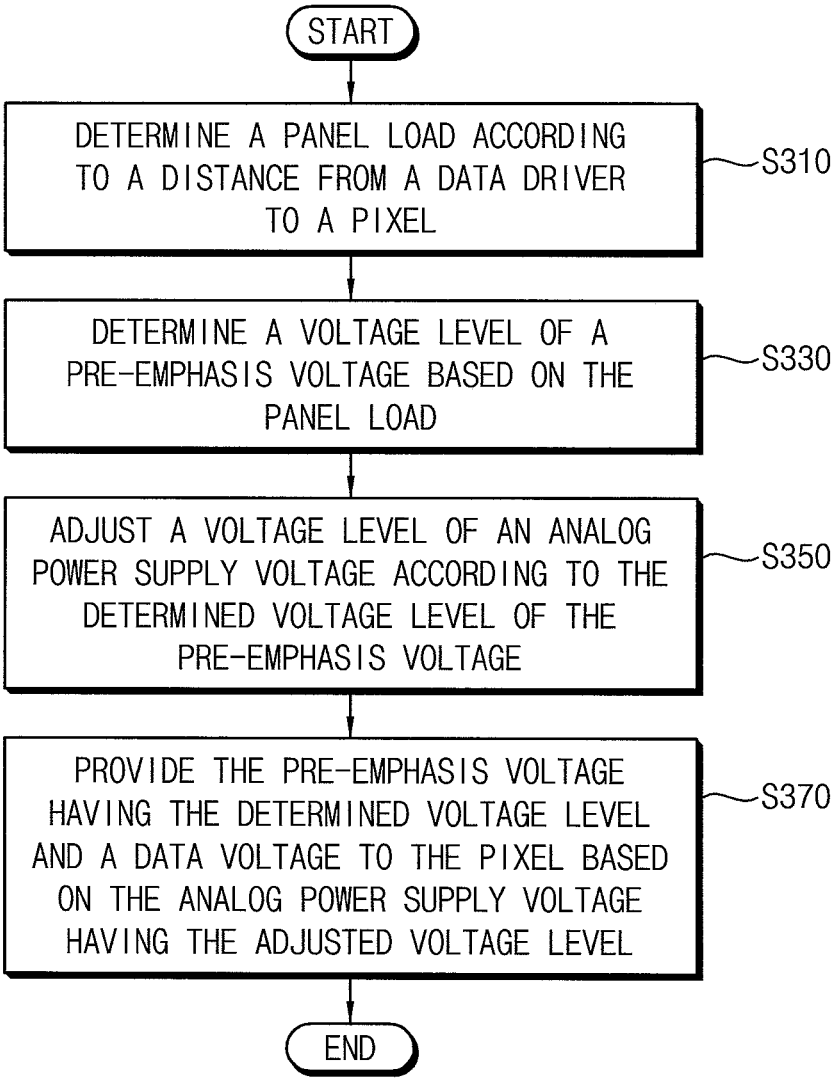
FIG. 6 is a flowchart illustrating a method of operating a display device according to some example embodiments.

FIG. 6 is a flowchart illustrating a method of operating a display device according to some example embodiments.

Referring to FIGS. 1 and 6, in a method of operating a display device 100 according to example embodiments, the display device 100 may determine a voltage level of a pre-emphasis voltage VPRE. In some example embodiments, to determine the voltage level of the pre-emphasis voltage VPRE, a pre-emphasis voltage determining block 150 of the display device 100 may determine a panel load of a display panel 110 according to a distance from a data driver 130 to each pixel PX to which the pre-emphasis voltage VPRE is applied (S310), and may determine the voltage level of the pre-emphasis voltage VPRE based on the panel load (S330). For example, as the panel load of the display panel 110 increases, or as the distance from the data driver 130 to the pixel PX increases, the pre-emphasis voltage determining block 150 may determine an amount of the voltage level of the pre-emphasis voltage VPRE to be increased. A controller 140 may provide the data driver 130 with a pre-emphasis voltage control signal SVPREL representing the determined voltage level of the pre-emphasis voltage VPRE.

The display device 100 may adjust a voltage level of an analog power supply voltage AVDD according to the determined voltage level of the pre-emphasis voltage VPRE (e.g., a determined desired increase in the voltage level of the pre-emphasis voltage VPRE) (S350). In some example embodiments, the controller 140 may provide an analog power supply voltage control signal SAVDDL to a power management circuit 160, and the power management circuit 160 may adjust the voltage level of the analog power supply voltage AVDD in response to the analog power supply voltage control signal SAVDDL received from the controller 140. For example, as the voltage level of the pre-emphasis voltage VPRE increases, the display device 100 may increase the voltage level of the analog power supply voltage AVDD. In some example embodiments, the display device 100 may adjust the voltage level of the analog power supply voltage VADD such that a difference between the analog power supply voltage VADD and the pre-emphasis voltage VPRE may be maintained as a margin voltage (e.g., a set or predetermined margin voltage).

The data driver 130 may receive the analog power supply voltage VADD having the adjusted voltage level as a power supply voltage for an analog circuit (e.g., an output buffer block 138 and/or a DAC block 136), and may provide the pre-emphasis voltage VPRE having the determined voltage level represented by the pre-emphasis voltage control signal SVPREL and a data voltage VDAT corresponding to an image data signal SDAT to each pixel PX based on the analog power supply voltage VADD having the adjusted voltage level (S370). Accordingly, the data voltage VDAT having a desired voltage level may be stored in each pixel PX, and the plurality of pixels PX may display an image corresponding to the data voltage VDAT.

As described above, in the method of operating the display device 100 according to example embodiments, the voltage level of the pre-emphasis voltage VPRE may be determined according to the panel load of the display panel 110, or according to the distance from the data driver 130 to each pixel PX to which the pre-emphasis voltage VPRE is applied, and the voltage level of the analog power supply voltage AVDD may be adjusted according to the determined voltage level of the pre-emphasis voltage VPRE. Accordingly, compared with a display device using a constant analog power supply voltage, the power consumption of the display device 100 according to example embodiments may be reduced.

Figure 7:
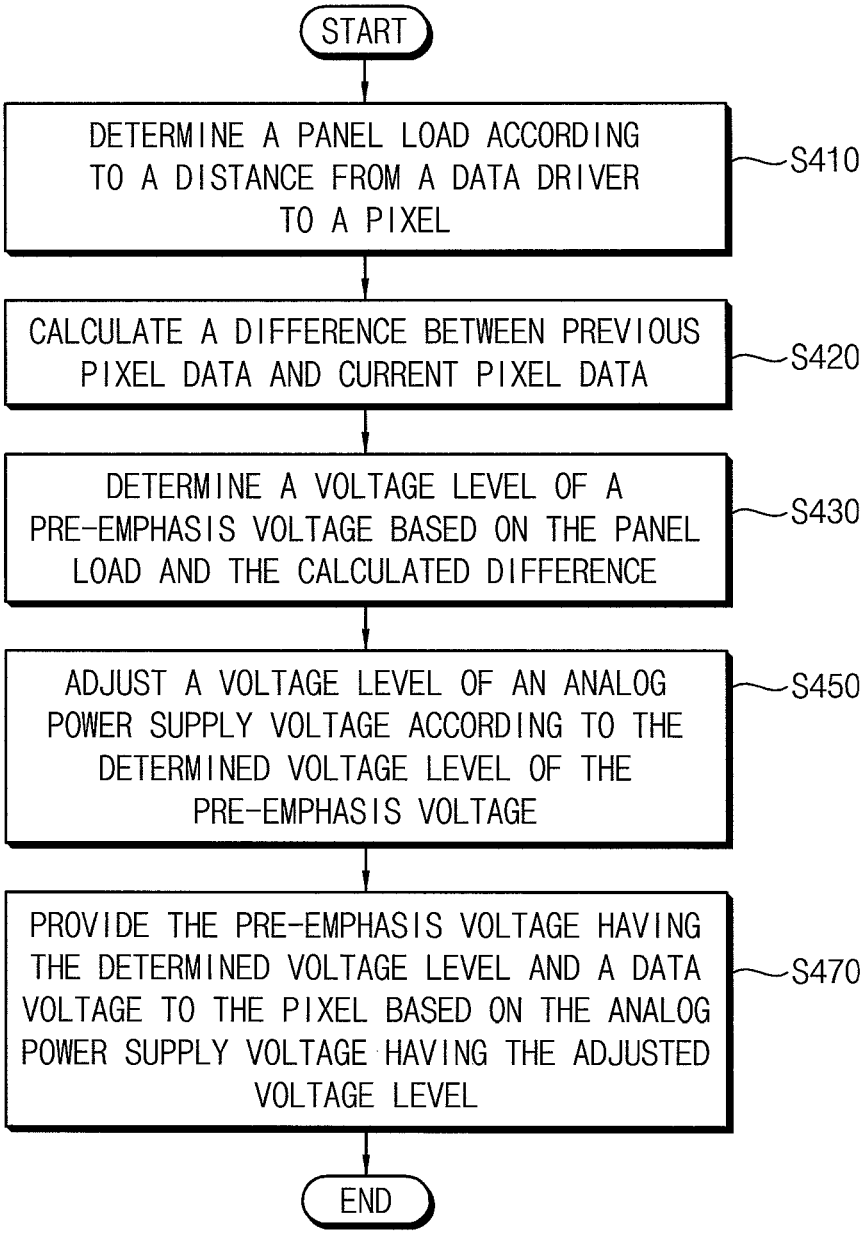
FIG. 7 is a flowchart illustrating a method of operating a display device according to some example embodiments.

FIG. 7 is a flowchart illustrating a method of operating a display device according to some example embodiments.

Referring to FIGS. 1 and 7, in a method of operating a display device 100 according to some example embodiments, the display device 100 may determine a voltage level of a pre-emphasis voltage VPRE. In some example embodiments, to determine the voltage level of the pre-emphasis voltage VPRE, a pre-emphasis voltage determining block 150 of the display device 100 may determine a panel load of a display panel 110 according to a distance from a data driver 130 to each pixel PX to which the pre-emphasis voltage VPRE is applied (S410), may calculate a difference between previous pixel data and current pixel data (S420), and may determine the voltage level of the pre-emphasis voltage VPRE based on the panel load and the calculated difference (S430). For example, with respect to two adjacent pixels PX coupled to the same data line, the previous pixel data may represent an image data signal SDAT for a pixel located in a previous row, and the current pixel data may represent an image data signal SDAT for a pixel located in a current row.

For example, the pre-emphasis voltage determining block 150 may increase the voltage level of the pre-emphasis voltage VPRE as the panel load of the display panel increases, or as the distance from the data driver 130 to the pixel PX increases, and may further increase the voltage level of the pre-emphasis voltage VPRE as the difference between the previous pixel data and the current pixel data increases. A controller 140 may provide the data driver 130 with a pre-emphasis voltage control signal SVPREL representing the determined voltage level of the pre-emphasis voltage VPRE.

The display device 100 may adjust a voltage level of an analog power supply voltage AVDD according to the determined voltage level of the pre-emphasis voltage VPRE (S450). In some example embodiments, the controller 140 may provide an analog power supply voltage control signal SAVDDL to a power management circuit 160, and the power management circuit 160 may adjust the voltage level of the analog power supply voltage AVDD in response to the analog power supply voltage control signal SAVDDL received from the controller 140. Further, in some example embodiments, the display device 100 may adjust the voltage level of the analog power supply voltage VADD such that a difference between the analog power supply voltage VADD and the pre-emphasis voltage VPRE may be maintained as a margin voltage (e.g., a set or predetermined margin voltage).

The data driver 130 may receive the analog power supply voltage VADD having the adjusted voltage level as a power supply voltage for an analog circuit (e.g., an output buffer block 138 and/or a DAC block 136), and may provide the pre-emphasis voltage VPRE having the determined voltage level represented by the pre-emphasis voltage control signal SVPREL and a data voltage VDAT corresponding to an image data signal SDAT to each pixel PX based on the analog power supply voltage VADD having the adjusted voltage level (S470). Accordingly, the data voltage VDAT having a desired voltage level may be stored in each pixel PX, and the plurality of pixels PX may display an image corresponding to the data voltage VDAT.

As described above, in the method of operating the display device 100 according to some example embodiments, the voltage level of the pre-emphasis voltage VPRE may be determined according to the panel load of the display panel 110 and the difference between the previous pixel data and the current pixel data, and the voltage level of the analog power supply voltage AVDD may be adjusted according to the determined voltage level of the pre-emphasis voltage VPRE. Accordingly, compared with a display device using a constant analog power supply voltage, the power consumption of the display device 100 according to some example embodiments may be reduced.

Figure 8:
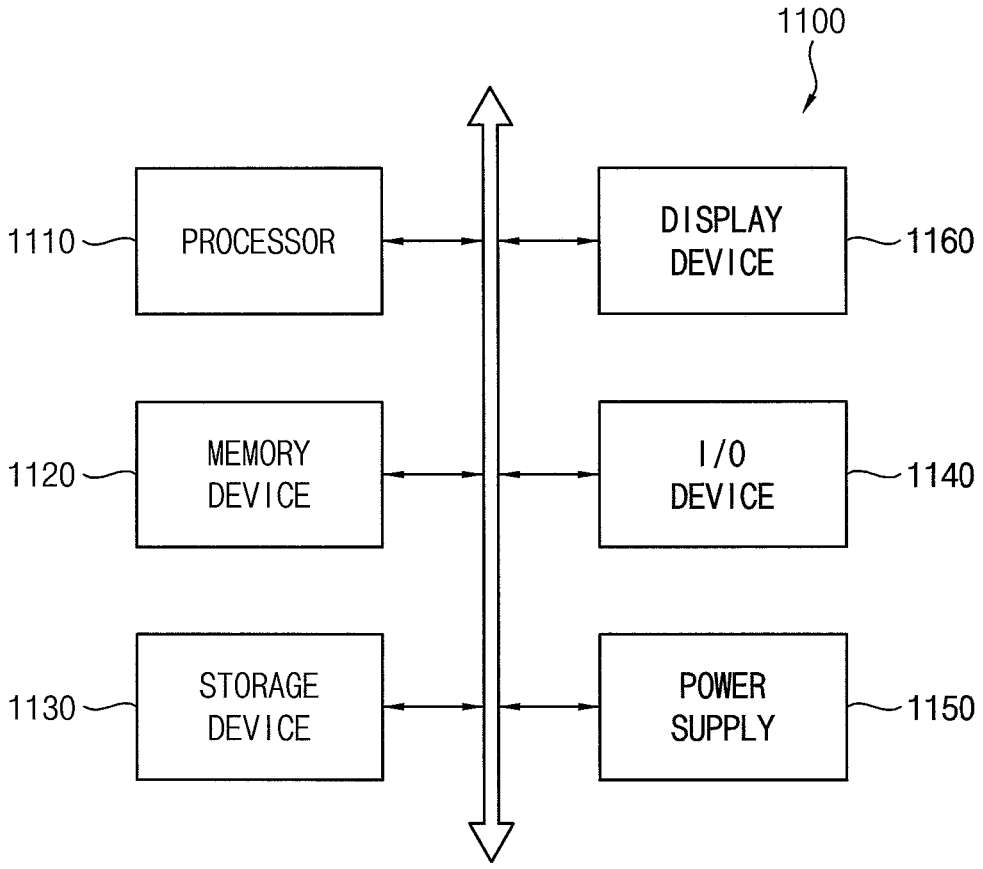
FIG. 8 is a block diagram illustrating an electronic device including a display device according to some example embodiments.

FIG. 8 is a block diagram illustrating an electronic device including a display device according to some example embodiments.

Referring to FIG. 8, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100.

The display device 1160 may adjust a voltage level of a pre-emphasis voltage according to a panel load of a display panel and/or a difference between previous pixel data and current pixel data, and may adjust a voltage level of an analog power supply voltage according to the adjusted voltage level of the pre-emphasis voltage. Accordingly, compared with a display device using a constant analog power supply voltage, the power consumption of the display device 1160 according to example embodiments may be reduced.

According to example embodiments, the electronic device 1100 may be any electronic device including the display device 1160, such as a digital television, a 3D television, a personal computer (PC), a home appliance, a laptop computer, a cellular phone, a smart phone, a tablet computer, a wearable device, a personal digital assistant (PDA), a portable multimedia player (PMP), a digital camera, a music player, a portable game console, a navigation system, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of pixels;

a power management circuit configured to convert an input voltage from a power source into an analog power supply voltage; and a data driver configured to provide a pre-emphasis voltage and a data voltage to the plurality of pixels based on the analog power supply voltage, wherein the display device is configured to adjust a voltage level of the pre-emphasis voltage according to a distance from the data driver to each of the plurality of pixels to which the pre-emphasis voltage is applied, and wherein the display device is configured to adjust a voltage level of the analog power supply voltage that is used as a power supply voltage for an analog circuit of the data driver according to an adjusted voltage level of the pre-emphasis voltage to maintain a constant margin voltage between the pre-emphasis voltage and the analog power supply voltage.

2. The display device of claim 1, wherein the display device is configured to increase the voltage level of the pre-emphasis voltage as the distance from the data driver to each of the plurality of pixels to which the pre-emphasis voltage is applied increases, and wherein the display device is configured to increase the voltage level of the analog power supply voltage as the voltage level of the pre-emphasis voltage increases.

3. The display device of claim 1, wherein the data driver is configured to provide the pre-emphasis voltage having a first voltage level to a first one of the plurality of pixels spaced apart by a first distance from the data driver, and to provide the pre-emphasis voltage having a second voltage level higher than the first voltage level to a second one of the plurality of pixels spaced apart by a second distance greater than the first distance from the data driver, and wherein the power management circuit is configured to provide the analog power supply voltage having a third voltage level to the data driver based on the data driver providing the pre-emphasis voltage having the first voltage level to the first one of the plurality of pixels, and to provide the analog power supply voltage having a fourth voltage level higher than the third voltage level to the data driver based on the data driver providing the pre-emphasis voltage having the second voltage level to the second one of the plurality of pixels.

4. The display device of claim 3, wherein the third voltage level of the analog power supply voltage is higher by the constant margin voltage than the first voltage level of the pre-emphasis voltage, and wherein the fourth voltage level of the analog power supply voltage is higher by the constant margin voltage than the second voltage level of the pre-emphasis voltage.

5. The display device of claim 1, further comprising:

a controller configured to control the power management circuit and the data driver, wherein the power management circuit is configured to adjust the voltage level of the analog power supply voltage in response to an analog power supply voltage control signal received from the controller.

6. The display device of claim 5, wherein the power management circuit includes:

a voltage converting block configured to convert the input voltage into the analog power supply voltage; and a switch control block configured to control the voltage converting block to adjust the voltage level of the analog power supply voltage in response to the analog power supply voltage control signal.

7. The display device of claim 5, wherein the analog power supply voltage control signal is transferred from the controller to the power management circuit through a single wire.

8. A display device comprising:

a display panel including a plurality of pixels;

a power management circuit configured to convert an input voltage from a power source into an analog power supply voltage;

a pre-emphasis voltage determining block configured to determine a voltage level of a pre-emphasis voltage; and a data driver configured to provide the pre-emphasis voltage having the determined voltage level and a data voltage to the plurality of pixels based on the analog power supply voltage, wherein the display devices is configured to adjust a voltage level of the analog power supply voltage that is used as a power supply voltage for an analog circuit of the data driver according to the determined voltage level of the pre-emphasis voltage to maintain a constant margin voltage between the pre-emphasis voltage and the analog power supply voltage.

9. The display device of claim 8, wherein the pre-emphasis voltage determining block is configured to determine the voltage level of the pre-emphasis voltage according to a distance from the data driver to each of the plurality of pixels to which the pre-emphasis voltage is applied.

10. The display device of claim 8, wherein the pre-emphasis voltage determining block is configured to determine the voltage level of the pre-emphasis voltage based on a distance from the data driver to each of the plurality of pixels to which the pre-emphasis voltage is applied, and a difference between previous pixel data and current pixel data.

11. The display device of claim 8, further comprising:

a controller configured to control the power management circuit and the data driver, wherein the power management circuit is configured to adjust the voltage level of the analog power supply voltage in response to an analog power supply voltage control signal received from the controller.

12. The display device of claim 11, wherein the power management circuit includes:

a voltage converting block configured to convert the input voltage into the analog power supply voltage; and a switch control block configured to control the voltage converting block to adjust the voltage level of the analog power supply voltage in response to the analog power supply voltage control signal.

13. The display device of claim 11, wherein the pre-emphasis voltage determining block is included in the controller.

14. A method of operating a display device, the method comprising:

determining a voltage level of a pre-emphasis voltage;

converting an input voltage from a power source into an analog power voltage;

adjusting a voltage level of an analog power supply voltage according to the determined voltage level of the pre-emphasis voltage to generate an adjusted voltage level to maintain a constant margin voltage between the pre-emphasis voltage and the analog power supply voltage; and providing the pre-emphasis voltage having the determined voltage level and a data voltage to a plurality of pixels of the display device based on the analog power supply voltage that is used as a power supply voltage for an analog circuit of the data driver having the adjusted voltage level.

15. The method of claim 14, wherein determining the voltage level of the pre-emphasis voltage includes:

determining a panel load according to a distance from a data driver to each of the plurality of pixels to which the pre-emphasis voltage is applied; and determining the voltage level of the pre-emphasis voltage based on the panel load.

16. The method of claim 14, wherein determining the voltage level of the pre-emphasis voltage includes:

determining a panel load according to a distance from a data driver to each of the plurality of pixels to which the pre-emphasis voltage is applied;

calculating a difference between previous pixel data and current pixel data; and determining the voltage level of the pre-emphasis voltage based on the panel load and the calculated difference.

17. The method of claim 14, wherein the voltage level of the analog power supply voltage is adjusted by a power management circuit in response to an analog power supply voltage control signal received from a controller.

* * * * *